US008876615B2

(12) United States Patent
Ochi

(10) Patent No.: US 8,876,615 B2
(45) Date of Patent: Nov. 4, 2014

(54) PLAYGROUND EQUIPMENT DRIVING MOTOR-PLACEMENT DEVICE AND ROTATING PLAYGROUND EQUIPMENT

(75) Inventor: Yasushi Ochi, Kaizuka (JP)

(73) Assignee: BLD Oriental Co., Ltd., Izumisano, Osaka Prefecture (JP)

( * ) Notice: Subject to any disclaimer, the term of this patent is extended or adjusted under 35 U.S.C. 154(b) by 94 days.

(21) Appl. No.: 13/703,792

(22) PCT Filed: Dec. 23, 2010

(86) PCT No.: PCT/JP2010/007462

§ 371 (c)(1),
(2), (4) Date: Dec. 12, 2012

(87) PCT Pub. No.: WO2011/158314

PCT Pub. Date: Dec. 22, 2011

(65) Prior Publication Data

US 2013/0095935 A1 Apr. 18, 2013

(30) Foreign Application Priority Data

Jun. 15, 2010 (JP) ..... 2010-136308

(51) Int. Cl.

| | |
|---|---|
| ***A63G 1/10*** | (2006.01) |
| ***A63G 1/12*** | (2006.01) |
| ***A63G 1/28*** | (2006.01) |
| *A63B 17/00* | (2006.01) |

(52) U.S. Cl.

CPC .. *A63G 1/10* (2013.01); *A63G 1/12* (2013.01); *A63G 1/28* (2013.01)

USPC ..... 472/29; 472/32; 482/35

(58) Field of Classification Search

CPC ..... A63B 17/00; A63G 1/00; A63G 1/08; A63G 1/10; A63G 1/12; A63G 1/28; A63G 1/30; A63G 31/00

USPC ..... 472/29, 32, 33, 42, 133, 136; 482/35–37

See application file for complete search history.

(56) References Cited

U.S. PATENT DOCUMENTS

| | | | |
|---|---|---|---|
| 2,819,899 | A | 1/1958 | Thumberg |
| 3,088,733 | A | 5/1963 | Ayres |

(Continued)

FOREIGN PATENT DOCUMENTS

| | | | |
|---|---|---|---|
| EP | 2058030 | A1 | 5/2009 |
| JP | 111677/1977 | U | 3/1979 |

(Continued)

OTHER PUBLICATIONS

International Search Report; Application No. PCT/JP2010/007462; Feb. 1, 2011; Japanese Patent Office.

(Continued)

*Primary Examiner* — Kien Nguyen

(74) *Attorney, Agent, or Firm* — Stevens & Showalter, LLP

(57) ABSTRACT

Provided are a driving motor-placement device to be used in rotating playground equipment that is superior in terms of maintenance, and rotating playground equipment. The disclosed playground equipment driving motor-placement device is characterized in that it is provided with a lower stationary component and an upper rotator; the lower stationary component is provided with a stationary plate that can be removed from the playground equipment and a shaft that stands upright on said stationary plate; the upper rotator is configured to be able to rotate around the shaft of said lower stationary component and is provided with a handle support that supports handles that users can grasp, and a driving motor support that supports the driving motor; said driving motor support is provided above the handle support;

and a coupling that transmits the rotation of the driving motor to the shaft of the lower stationary component is fixed to the top of said shaft.

13 Claims, 12 Drawing Sheets

(56) References Cited

U.S. PATENT DOCUMENTS

| | | | | |
|---|---|---|---|---|
| 3,661,386 | A | 5/1972 | Green | |
| 4,805,898 | A | 2/1989 | Jacober et al. | |
| 5,407,393 | A | 4/1995 | Schmidt | |
| 5,453,053 | A * | 9/1995 | Danta et al. | 472/29 |
| 6,582,315 | B1 | 6/2003 | Formanski | |
| 7,182,694 | B2 * | 2/2007 | Ochi | 472/29 |
| 7,572,189 | B2 * | 8/2009 | Gentile et al. | 472/50 |
| 7,959,513 | B2 | 6/2011 | Ochi | |
| 8,313,388 | B2 * | 11/2012 | Ochi | 472/29 |
| 8,602,902 | B2 | 12/2013 | Ochi | |
| 8,608,582 | B2 | 12/2013 | Ochi | |
| 8,795,094 | B2 | 8/2014 | Ochi | |
| 2009/0012122 | A1 | 1/2009 | Branch et al. | |
| 2010/0048310 | A1 | 2/2010 | Ochi | |
| 2013/0090176 | A1 | 4/2013 | Ochi | |
| 2013/0095935 | A1 | 4/2013 | Ochi | |
| 2013/0133556 | A1 | 5/2013 | Ochi | |

FOREIGN PATENT DOCUMENTS

| | | | |
|---|---|---|---|
| JP | 139254/1978 | U | 4/1980 |
| JP | 125903/1982 | U | 4/1984 |
| JP | 62-129072 | A | 6/1987 |
| JP | 73404/1989 | U | 2/1991 |
| JP | 4-15989 | U | 2/1992 |
| JP | H07-098782 | | 4/1995 |
| JP | 7-265548 | A | 10/1995 |
| JP | 8-38649 | A | 2/1996 |
| JP | 08164279 | A | 6/1996 |
| JP | 8-211330 | A | 8/1996 |
| JP | H08-196747 | | 8/1996 |
| JP | 8-229244 | A | 9/1996 |
| JP | 2009108449 | A | 4/1997 |
| JP | H10113474 | A | 5/1998 |
| JP | H11-299635 | | 11/1999 |
| JP | 2000-116959 | A | 4/2000 |
| JP | 2000167254 | | 6/2000 |
| JP | 2000197715 | | 7/2000 |
| JP | 2001-169864 | A | 6/2001 |
| JP | 2004-208844 | A | 7/2004 |
| JP | 2004275492 | A | 10/2004 |
| JP | 2005-52305 | A | 3/2005 |
| JP | 2005131215 | A | 5/2005 |
| JP | 2008067741 | A | 3/2008 |
| JP | 2008073497 | A | 4/2008 |
| JP | 2008536082 | A | 9/2008 |
| JP | 2008231904 | A | 10/2008 |
| JP | 200911421 | A | 1/2009 |
| WO | 2006025108 | A1 | 3/2006 |
| WO | 2008032687 | A1 | 3/2008 |

OTHER PUBLICATIONS

International Search Report; Application No. PCT/JP2010/002877; Jun. 22, 2010; Japanese Patent Office.

Naoki Turuoka; Written Opinion of the International Searching Authority; Application No. PCT/JP2010/002877; Jun. 22, 2010; Japanese Patent Office.

Ochi, Yasushi; U.S. Appl. No. 13/497,070, filed Apr. 21, 2010 I.A. Date; entitled Tree-Shaped Decoration Apparatus.

Ochi, Yasushi; U.S. Appl. No. 13/497,085, filed Apr. 21, 2010 I.A. Date; entitled Slide Device.

Ochi, Yasushi; U.S. Appl. No. 13/497,116, filed Apr. 21, 2010 I.A. Date; entitled Rocking Play Device.

Ochi, Yasushi; U.S. Appl. No. 13/497,095, filed Apr. 21, 2010 I.A. Date; entitled Amusement Apparatus.

Ochi, Yasushi; U.S. Appl. No. 13/497,102, filed Apr. 21, 2010 I.A. Date; entitled Amusement Apparatus.

International Search Report; Application No. PCT/JP2010/002878; May 25, 2010; Japanese Patent Office.

Yosiaki Usui; Written Opinion of the International Searching Authority; Application No. PCT/JP2010/002878; May 25, 2010; Japanese Patent Office.

International Search Report; Application No. PCT/JP2010/002875; Jun. 1, 2010; Japanese Patent Office.

International Search Report; Application No. PCT/JP2010/002873; Jun. 8, 2010; Japanese Patent Office.

Tamotu Sakaii; Written Opinion of the International Searching Authority; Application No. PCT/JP2010/002873; Jun. 8, 2010; Japanese Patent Office.

International Search Report; Application No. PCT/JP2010/002872; Jun. 1, 2010; Japanese Patent Office.

Makoto Suzuki; Written Opinion of the International Searching Authority; Application No. PCT/JP2010/002872; Jun. 1, 2010; Japanese Patent Office.

International Search Report; Application No. PCT/JP2010/002876; Jul. 6, 2010; Japanese Patent Office.

Tuneaki Oota; Written Opinion of the International Searching Authority; Application No. PCT/JP2010/002876; Jul. 6, 2010; Japanese Patent Office.

* cited by examiner (A)

(B)

(A)

(B)

(A)

(B)

(A)

(B)

PLAYGROUND EQUIPMENT DRIVING MOTOR-PLACEMENT DEVICE AND ROTATING PLAYGROUND EQUIPMENT

TECHNICAL FIELD

The present invention relate to a playground equipment driving motor-placement device for rotating playground equipment, and in particular, it relates to a rotating playground equipment allowing users to hold and play.

BACKGROUND ART

A rotatable playground equipment which a user (mean infants and young children) can hang from, can attract users. Also, the demand for such amusement apparatus is high. For example, following patent document 1 discloses a rotation playground equipment capable of entertaining infants and children seated or hung from it.

SUMMARY OF THE INVENTION

Problem Invention is to Solve

The rotary playground equipment described in the above patent document rotates, by the shifting of user's weights. However, the rotary playground equipment of the disclosure in the patent document does not rotate when no users seat. When the rotary playground equipment does not rotate, it cannot be distinguished from normal chairs, thus it is difficult to make users think that they want to play a game such as a sitting and holding game, with the rotary playground equipment.

On the other hand, the infants and the little users are easily interested in moving things. Therefore, if rotary playground equipments rotates by a drive motor automatically, it can attract the interest of the user. So the playground equipment maker had the demand for a rotatable playground equipment with a drive motor. However, depending on the position of the drive motor (mean that a drive motor occupies most of the space), it would be disadvantageous for maintenances, so many playground equipment meters didn't want the rotating playground equipments comprising the drive motor provided.

Furthermore, drive motors are often placed in the position that is not visible from external (e.g., the inside of the strut). For example, when a drive motor is placed in the strut, the heat of the drive motor is hard to be emitted to external of the strut, the temperature of the drive motor rises, and the rotation of the motor thereby stops. Therefore, because the drive motor frequently stops caused by the heat, the playground equipments makers didn't want to attaching a drive motor to the rotating playground equipment. Security does not have a problem, even if the temperature of the drive motor rises, the drive motor only stops. An object of the present invention is to provide a playground equipment driving motor-placement device and a rotating playground equipment which is rotatable by a drive motor and is easy maintenance.

Means for Resolving the Problem

The present invention to solve above problems is a playground equipment driving motor-placement device provided with a lower stationary component and an upper rotator. The lower stationary component comprises a stationary plate removable to a playground equipment and a lower stationary component having a shaft vertically arranged by the stationary plate. And, the upper rotator is configured to be able to rotate around the shaft of said lower stationary component, and is provided with a handle support that supports handles that users can grasp, and a driving motor support that supports the driving motor; the driving motor support is provided above the handle support. And, a coupling is fixed to the upper portion of a shaft, for conveying the rotation of the drive motor to a shaft of the lower stationary component.

By the above configuration, the upper rotator is rotatable relative to the lower stationary component, a drive motor is placeable to the upper part of the driving motor support of the upper rotator. And a coupling is fixed to the upper portion of a shaft, for conveying the rotation of the drive motor to a shaft of the lower stationary component. Thus the playground equipment placing a drive motor to the upper part and rotating the whole apparatus, can be easily configured by using the playground equipment driving motor-placement device of the present invention.

In accordance with an aspect of the present invention, a torque limiter provided on the upper rotator, for controlling a driving torque of a rotating axis of the drive motor within predetermined value can be provided. Alternatively, a inverter provided on the upper rotator, for stopping a supply to the drive motor, when currents more than or equal to a predetermine value are supplied to the drive motor. Furthermore, a slip ring for supplying electric power to the playground equipment driving motor-placement device may be provided.

The playground equipment of the present invention, it is assumed that it rotates while a user grips it, so it is desirable to employ the above configuration for an excessive load. Furthermore, it can be effectively prevented that the lines such as power lines get twisted up because a slip ring which is provided in the upper rotator rotates along with the upper rotator.

In accordance with an aspect of the present invention, the upper rotator may be configured to make eccentric rotation. For example, a through-hole is formed to an eccentrically placed position from the center of the upper rotator, and a shaft passes through the through-hole. By the above configuration, further complicated rotating playground equipment can be provided, so it can further the interest of users.

The rotating playground equipment comprising the playground equipment driving motor-placement device as configured above, is provided with a substrate, with a column vertically arranged on the substrate, and with a coating unit. A drive motor for driving the rotating playground equipment is comprised in the playground equipment driving motor-placement device placed in the upper part of the column. And, the playground equipment driving motor-placement device including the drive motor is surrounded by the coating unit. A heat releasing unit is comprised on the upper part of the coating unit. Furthermore, it is desirable to employ the configuration that a handle is supported by the handle support of the playground equipment driving motor-placement device.

In the rotating playground equipment as configured above, a drive motor is placed in the upper part of the rotating playground equipment, so for example, it is not necessary to place the drive motor in the column. Furthermore, by surrounding the playground equipment driving motor-placement device including the drive motor by the coating unit, it effectively prevents viewing the drive motor from external. A heat releasing unit is provided to the upper part of the coating unit, so it can release heat of the drive motor outside, without viewing the drive motor from external. The heat releasing unit is configured by opening the upper part of the coating means and by a net provided in the opening In accordance with an aspect of the present invention, it is desirable to that the handle is a plurality of arm-shaped members, that a supporting rod hung from ends of each arm-shaped member is provided, and that a ring for horizontally coupling the each supporting rod is provided. By the above configuration, the playground equipment comprising the arm-shaped handle can be provided.

Furthermore, several pairs of different-sized arm-shaped members may be supported to the handle support of the playground equipment driving motor-placement device, and a double ring having a ring for horizontally coupling the supporting rod may be hung from the end of the pair of the arm-shaped members. Furthermore, the handle may be zig-zag-shape in lateral view, coupling the ends of the plurality of the rings to each other, and a beam placed by a ring of the stairhead may be supported to the handle support of the playground equipment driving motor-placement device.

In accordance with an aspect of the present invention, the upper part of the column is bent, and the playground equipment driving motor-placement device may be placed on the upper part of the column being bent. Further complicated rotating playground equipment can be provided by installing the drive motor on the bent column, with the motor-placement device, and it can further the interest of users.

Furthermore, the handle is placed on the handle support of the playground equipment driving motor-placement device. The handle may be a ring having a central handle portion. It is desirable to be coated between the central handle portion and the ring, with a flexible sheet including at least transmittance sheet.

By installing the drive motor on the bent column, with the motor-placement device, a ring (of course, the central handle portion is placed on a center of the ring. Furthermore, other than a circle, the shape of the ring may be rectangular or polygon shape) having the central handle portion is placed as the handle, and the space between the central handle portion and ring is coated by the transmittance sheet so that users can view the lower part, in the conditions gripping the central handle portion. At least part of a flexible sheet may be formed with a sheet of the translucency.

Effects of the Invention

This invention is a playground equipment driving motor-placement device provided with a lower stationary component and an upper rotator. The lower stationary component is provided with a stationary plate that can be removed from the playground equipment and a shaft that stands upright on said stationary plate. And, the upper rotator is rotatable about the shaft of the lower stationary component, and is provided with a handle support that supports handles that users can grasp, and a driving motor support that supports the driving motor. The driving motor support is provided above the handle support. And, a coupling is fixed to the upper portion of a shaft, for conveying the rotation of the drive motor to a shaft of the lower stationary component.

By above configuration, the upper rotator is rotatable against the lower stationary component, and a drive motor is placeable to an upper part of the driving motor support of the upper rotator. And, a coupling is fixed to the upper portion of a shaft, for conveying the rotation of the drive motor to a shaft of the lower stationary component, so the playground equipment placing a drive motor to the upper part and rotating the whole apparatus, can be easily configured by using the playground equipment driving motor-placement device of the present invention. Therefore, it can be evaded that a drive motor occupies most of the space of the playground equipment. And it can diffuse the heat of the drive motor from the upper part. The rotating playground equipment having an ease of for maintenance can be provided.

DESCRIPTION OF THE PREFERRED EMBODIMENT

Detailed Description of the Preferred Embodiment 1

Figure 1:
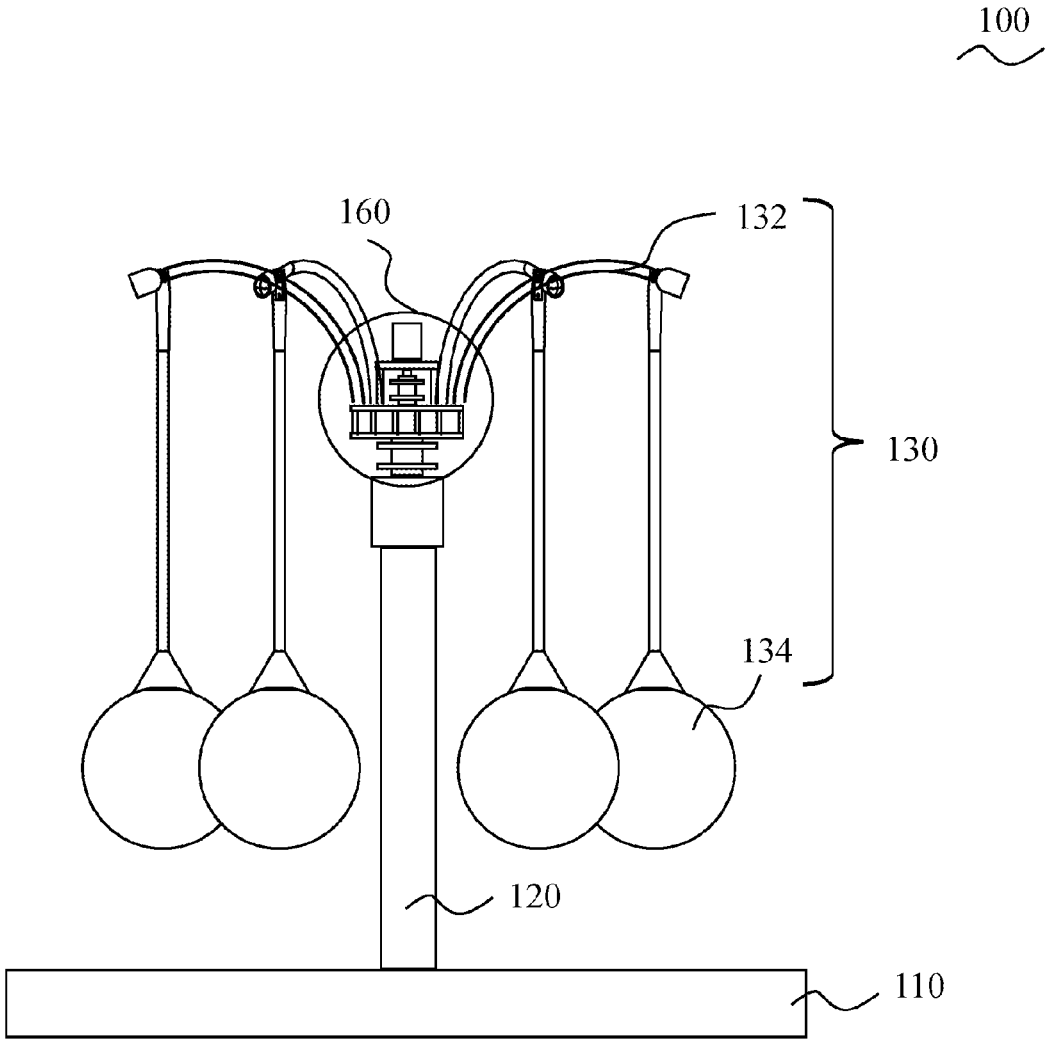
FIG. 1 is a side-view illustrating an outlined configuration of a rotating playground equipment in accordance with an embodiment of the present invention.
Figure 2:
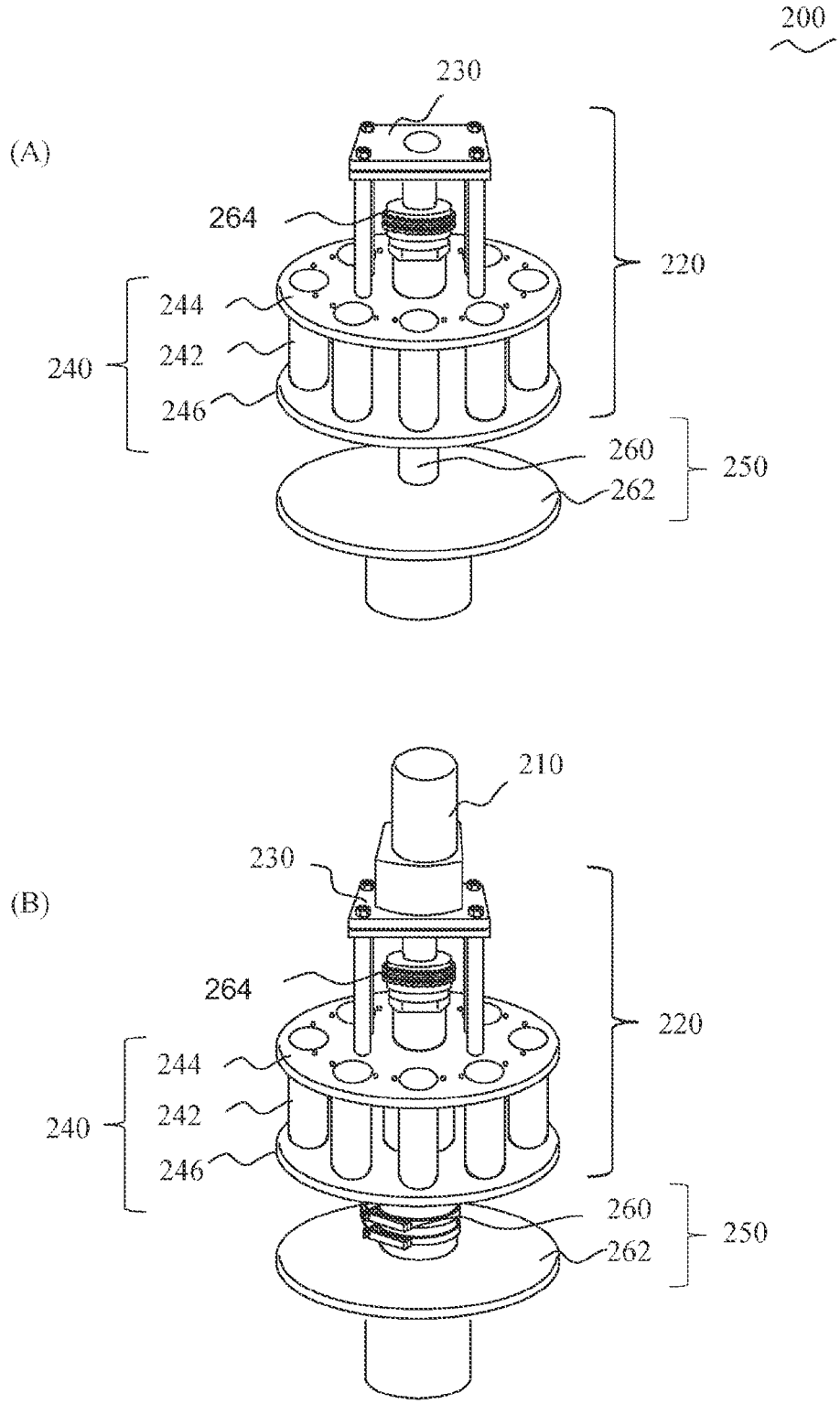
FIG. 2 is a perspective view illustrating an outlined configuration of a playground equipment driving motor-placement device in accordance with an embodiment of the present invention.
Figure 3:
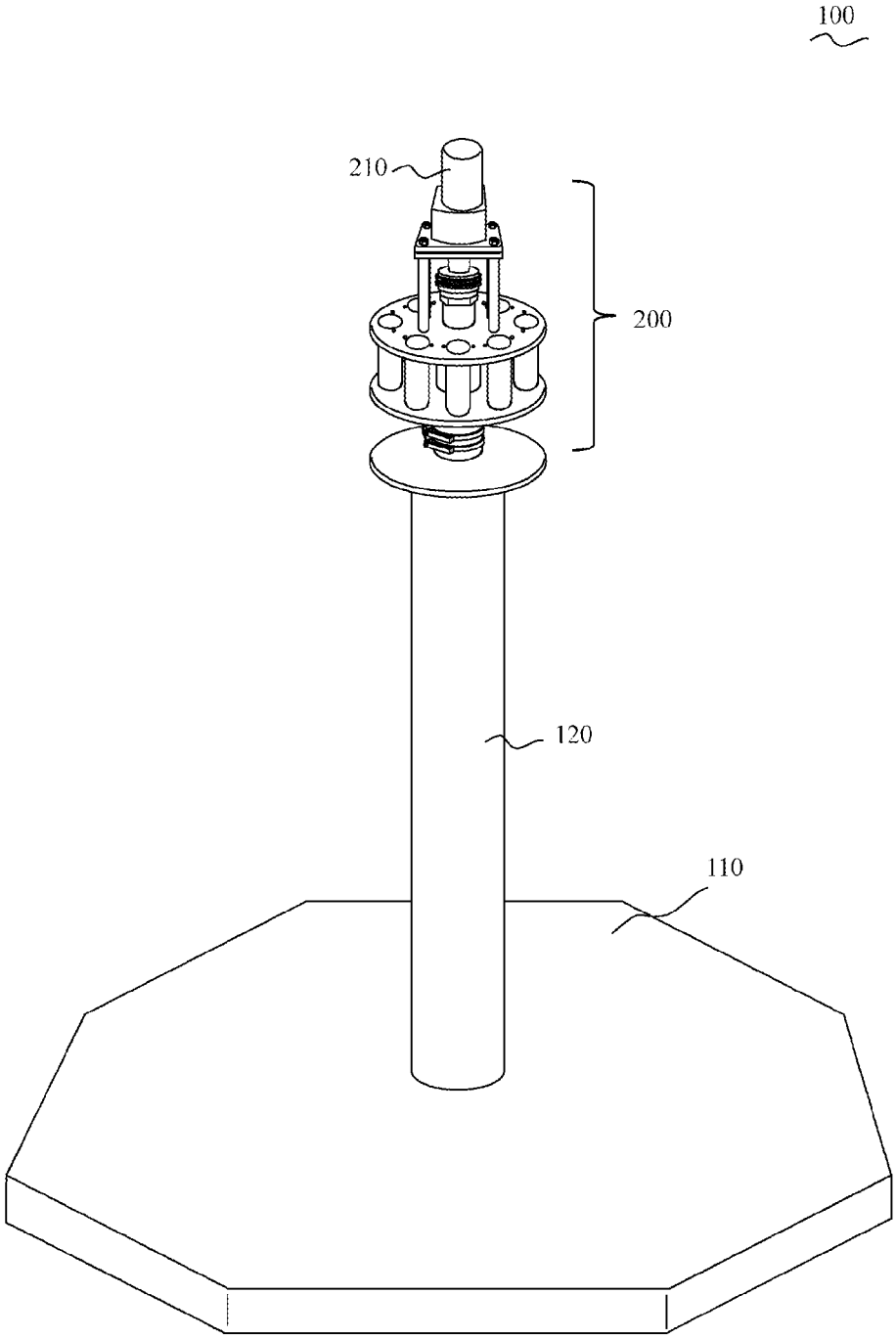
FIG. 3 is a perspective view illustrating an outlined configuration of a rotating playground equipment in accordance with an embodiment of the present invention.
Figure 4:
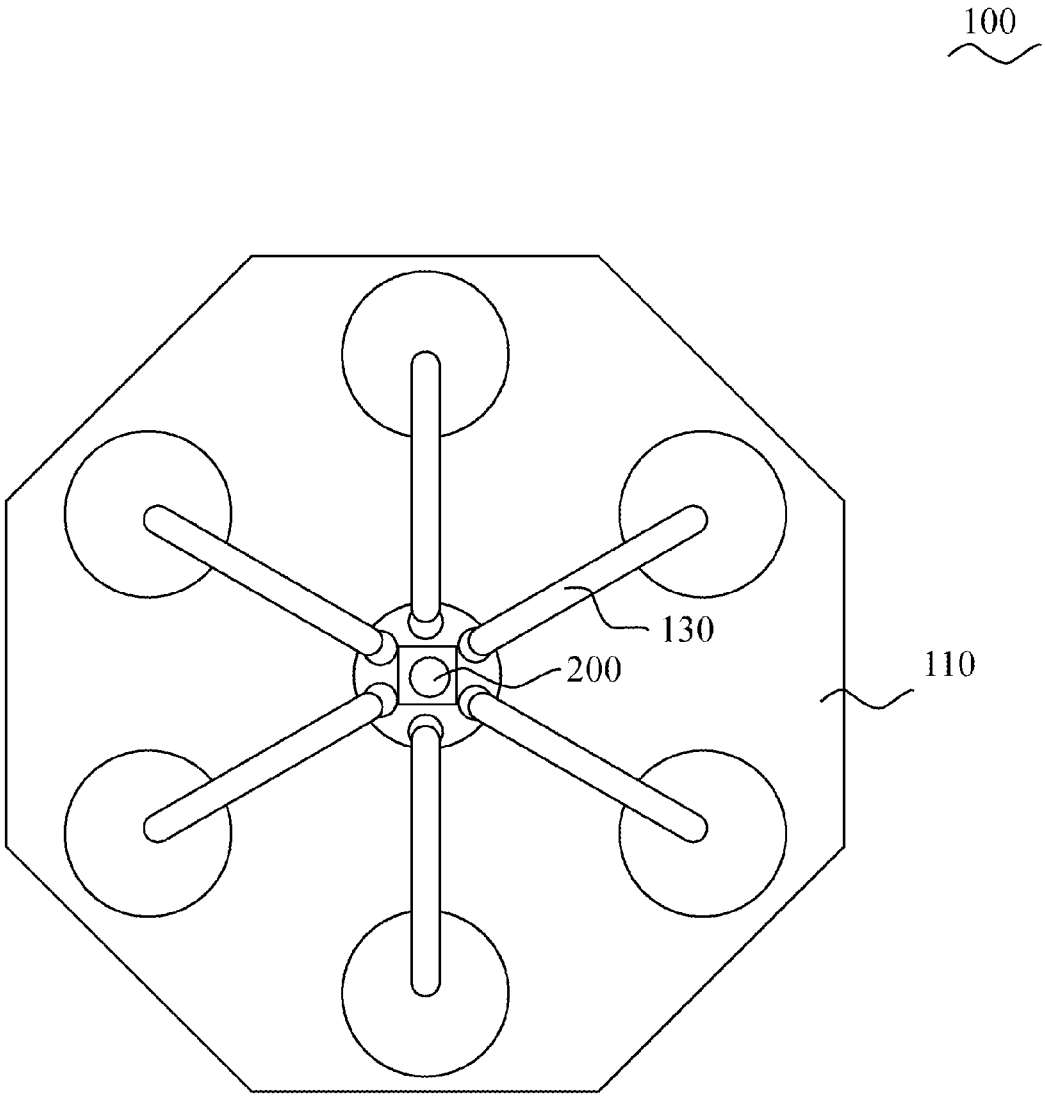
FIG. 4 is a top view of a rotating playground equipment in accordance with an embodiment of the present invention.

A specified embodiment of a rotating playground equipment 100 is explained hereinafter with reference to the accompanying drawings. FIG. 1 is an outline schematic view showing the whole configuration of a rotating playground equipment 100 of the present invention, FIG. 2 is an outline schematic view of a playground equipment driving motor-placement device 200 placed to the rotating playground equipment 100 of the present invention. FIG. 3 is a figure of a playground equipment driving motor-placement device 200 placed in an upper portion of after-mentioned strut 120. FIG. 4 is a outline schematic view that shows the rotating playground equipment 100 of the present invention from the upper part. However, the details of all the parts which do not directly-relate to the present invention will be omitted.

As shown in FIG. 1, a rotating playground equipment 100 of the present invention is provided with a column 120 vertically arranged to a substrate 110 and with a handle 130 rotatable hung down from upper parts of column 120. It is described below about a drive motor 210 attached to the rotating playground equipment 100. At first, a predetermined substrate 110 is formed.

In the present embodiment, as shown in FIG. 3, FIG. 4, a substrate 110 in the top view is formed as a octagon. And, a column 120 is stood on a column fixing member (not shown) provided in center of the substrate 110. The shape of the substrate 110 is not limited to an octagon. However, it is necessary that a column 120 attached to the drive motor 210 can stand stability because as will be described below a drive motor 210 is attached to upper part of the column of the rotating playground equipment 100 of the present invention. As for column 120 vertically arrange to substrate 110 it is desirable to use a cylinder having a cavity so that it can engage the after-mentioned motor-placement device 200.

The mounting arrangement of the drive motor 210 will now be described. The characteristic of the invention is to place the drive motor 210 to the upper portion of the column. At first, a motor-placement device 200 for placing the drive motor 210 to the upper portion of the column 120 is formed. The motor-placement device 200 has an upper rotator 220 and a lower stationary component 250. The upper rotator 220 comprises a driving motor support 230 for supporting the drive motor 210 and a handle support 240 for supporting a handle 130 (hereinafter referred to as a holding for users). And, the upper rotator 220 is coaxially supported with the lower stationary component 250 and the upper rotator 220 is rotatably supported about the axle. Furthermore, the drive motor 210 is supported to the upper rotator 220, with the rotating axle facing downward. When the rotating axle or shaft of the motor rotates, the upper rotator 220 rotates around the axle of the lower stationary component 250. That is to say, for example, a shaft 260 is stood on top face center of a stationary plate 262, the shaft 260 rotatably passes through in the through-hole formed to upper rotator 220. And, by fixing a coupling 264 rotated by the drive motor 210 to the shaft 260, when rotating axis of the drive motor 210 rotates, the upper rotator 220 supporting the drive motor 210 rotates the shaft 260 as axle. The stationary plate 262 and shaft 260 correspond to a lower stationary component 250.

Furthermore, in the present embodiment, a handle support 240 for supporting the handle 130 to the upper rotator 220 is provided. For example, as shown in FIG. 2 (A), FIG. 2 (B), a plurality of pipe bodies (e.g., pipe 242) are placed in an annular shape. The handle support 240 is formed by sandwiching the plurality of pipes 242 with top and bottom boards (use two pieces of board 244, 246) which are formed with openings of the shape same as an inside diameter of the plurality of pipes 242. Therefore, in the conditions where an opening of the plurality of pipes 242 is passed through, sandwiching the plurality of pipes 242 with the top and bottom board 244, 246 configures a handle support 240. Of course, an opening where the shaft 260 passes through rotatably is formed to the center of the handle support 240.

On the other hand, to the handle 130 supported to the handle support 240, a flange is formed to the place away from the one end of it by a predetermined distance. And, the handle 130 is supported by inserting an edge where the flange of the handle 130 is formed, into an opening formed to the handle support 240.

As shown in FIG. 2 (A), FIG. 2 (B), the driving motor support 230 is provided above the handle support 240. As described above, the driving motor support 230 can support, in the rotating axis of the drive motor 210 facing downward. For example, a drive motor supporting table is formed on the top surface of the handle support 240. And, an opening which the rotating axis of drive motor 210 can pass through is formed in a top plate of the drive motor supporting table. The upper rotator 220 is formed by placing the drive motor supporting table on the top surface of the handle support 240. And, the lower stationary component 250 can rotate and supports the above upper rotator 220. The motor-placement device 200 of the present invention is formed by, for example, coupling the shaft 260 of swivelling axis and above lower stationary component 250 and the drive motor 210 with coupling 264. The upper rotator 220 is rotatably supported to the lower stationary component 250, and for example, by a coupling for connecting the rotating axis of drive motor 210 with the shaft 260 of the lower stationary component 250. By the above configuration, a rotation of the drive motor 210 is conveyed into the shaft 260 via the coupling 520, so the upper rotator 220 rotates relative to the lower stationary component 250.

And, the rotating playground equipment 100 of the present invention is formed by attaching the motor-placement device 200 configured as above to the column 120. That is to say, the lower stationary component 250 of above motor-placement device 200 is fit in upper parts of above column 120, and by fixing by a fastening means such as a bolt and nut, as shown in FIG. 3, the rotating playground equipment 100 that drive motor 210 is placed in the upper part is formed.

(Handle)

A handle 130 is placed to the playground equipment 100 formed as above. For example, arm-shaped member (hereinafter called the arm-shaped member 132) as shown in FIG. 1 is used as handle 130. The rotating playground equipment 100 of the shape of the palm tree may be formed by attaching arm-shaped member 132 having a ball 134 hung down in the other end (mean a reverse end to place attached to the handle support 240) to the handle support 240 of the motor-placement device 200. It is desirable to symmetrically place the arm-shaped member 132 to the playground equipment driving motor-placement device 200 as shown in FIG. 4.

(Others)

Figure 5:
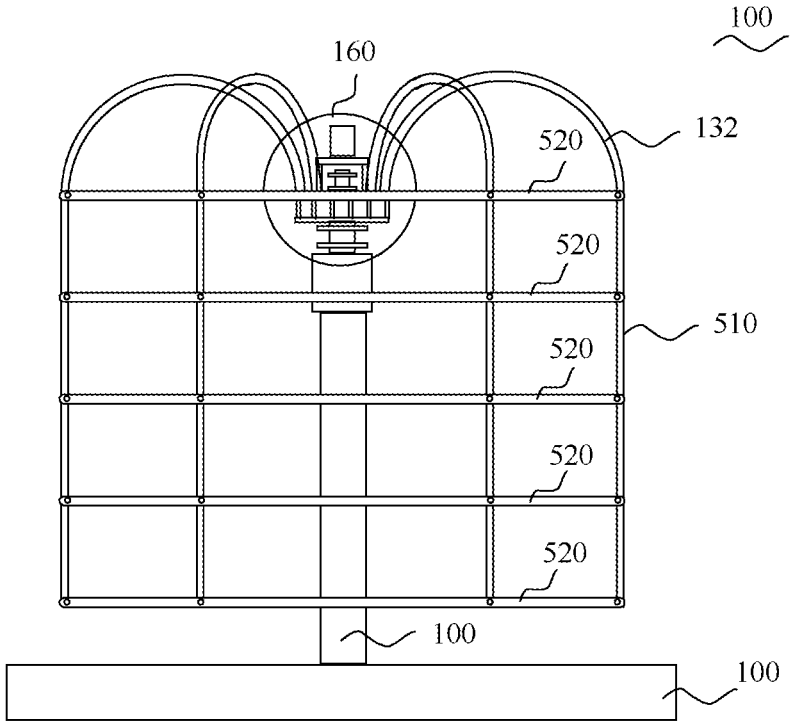
FIG. 5 is a side-view and top view illustrating an outlined configuration of a rotating playground equipment in accordance with an embodiment of the present invention.
Figure 5:
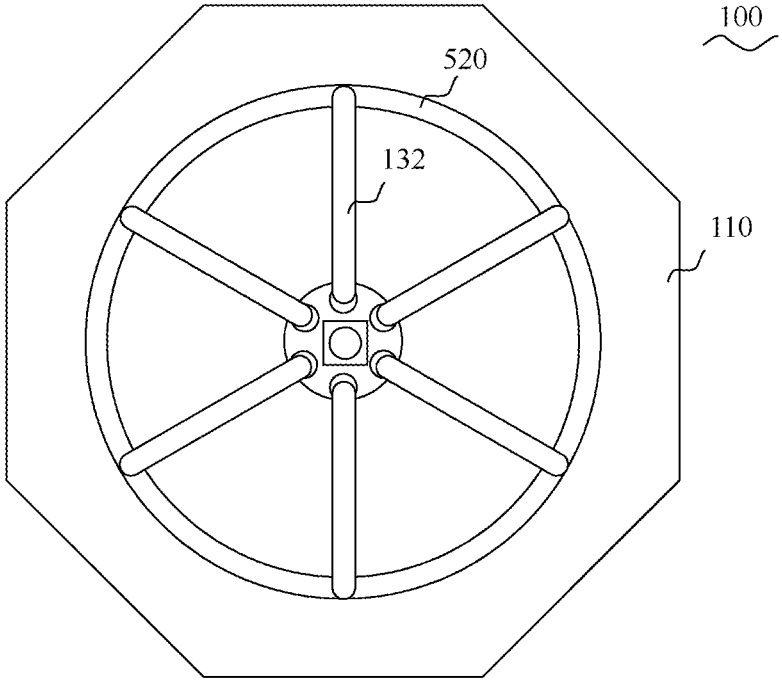

As shown in FIG. 5, a vertically placed rod 510 is hung to the other end of each arm-shaped member 132. Alternatively, the other end of each arm-shaped member 132 may be attached by extended to the handle support 240. And, the rotating playground equipment 100 may be configured by fixing each vertically placed rod 510 by a ring 520. In accordance with exemplary embodiments, the rotating playground equipment 100 of the jungle gym shape is formed by horizontally fixing the plurality of rings 520 to each vertically placed rod 510.

Figure 6:
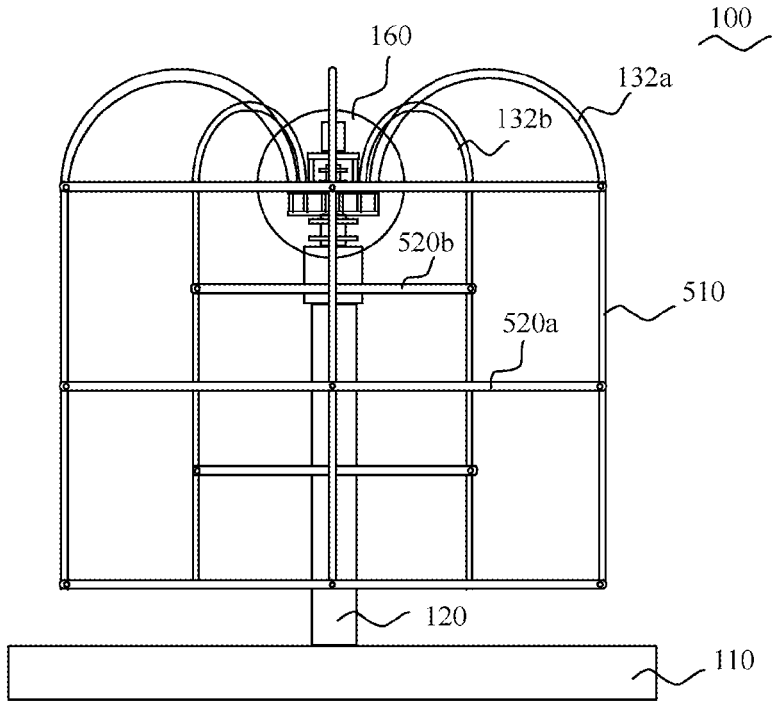
FIG. 6 is a side-view and top view illustrating an outlined configuration of a rotating playground equipment in accordance with an embodiment of the present invention.
Figure 6:
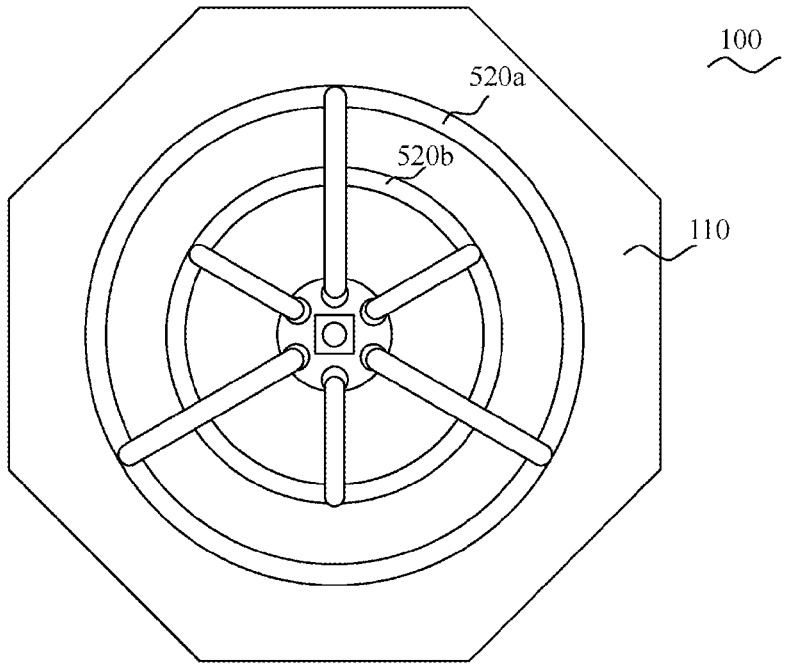

Furthermore, two kinds of arm-shaped members 132 of small and large size (hereinafter referred to as large size arm-shaped member 132 and small size arm-shaped member 132) is attached to driving motor support 230, and can be fixed with a double ring. That is to say, a vertically placed rod 510 is hung from the other end of each large size arm-shaped member 132 and a small size arm-shaped member 132. For example, the vertically placed rods 510 hung down from the large size arm-shaped members 132 are fixed by a large ring 520, and furthermore the vertically placed rods 510 hung down from the small size arm-shaped member 132 are fixed by a small ring 520, and thus the rotating playground equipment 100 of the jungle gym shape having a double ring can be configured as shown in FIG. 6.

Figure 7:
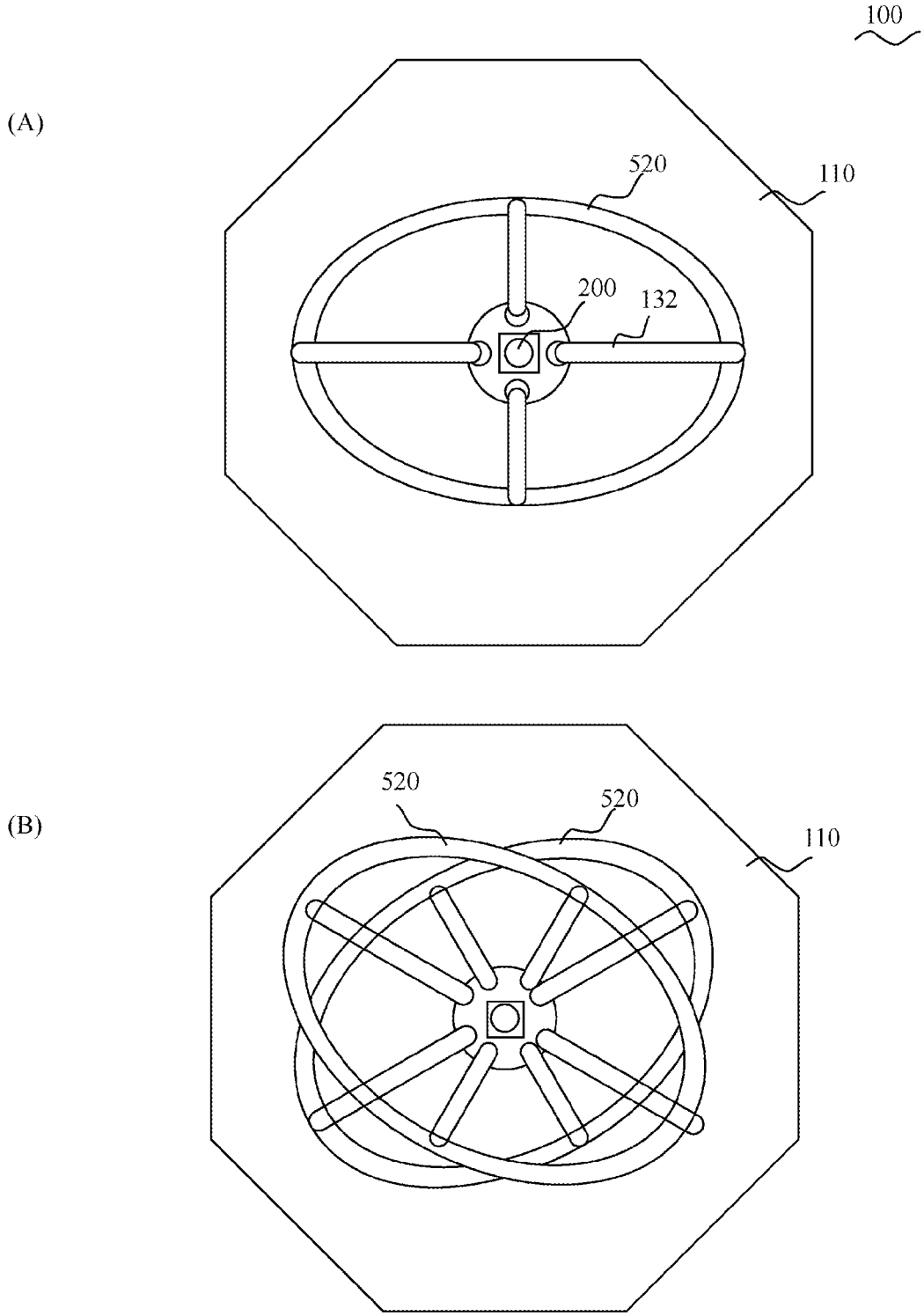
FIG. 7 is a side-view illustrating an outlined configuration of a rotating playground equipment in accordance with an embodiment of the present invention.

The ring 520 for fixing the vertically placed rod 510 hung down from the arm-shaped member 132 is not limited to a circle-shaped ring 520, it may be form of oval and rectangle shape or the like as shown in FIG. 7. Furthermore, the motor-placement device 200 including drive motor 210 may be covered with spherical protective member 160. The heat from the drive motor 210 can be released to outside by forming an opening on the upper part of spherical protective member 160. As for the rotating playground equipment of the present invention, the drive motor 210 is rotationally supported on the upper portion. Therefore, in order to prevent users from contacting to the drive motor 210, it is surrounded by the protective member 160 as described above. Of course, the protective member 160 is not limited to a spherical type, and in any position, if it can form the opening or a plurality of openings capable of releasing heat caused by the drive motor 210. The protective member 160 of any shape such as cubic shape, cylinder shape or the like is preferably used. Meshes may be used to the plurality of openings.

Detailed Description of the Preferred Embodiment 2

Figure 8:
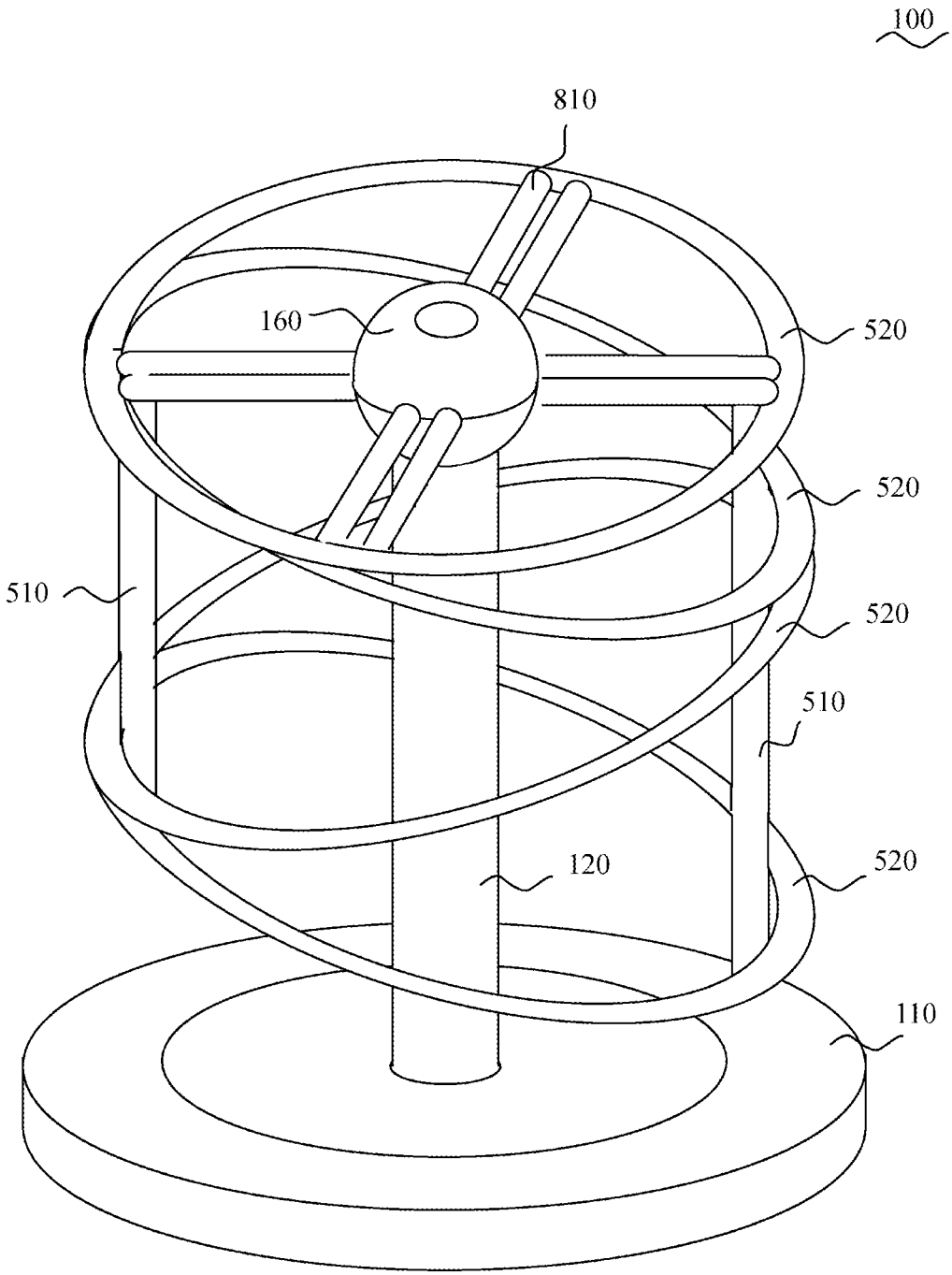
FIG. 8 is a perspective view illustrating an outlined configuration of a rotating playground equipment in accordance with an embodiment of the present invention.

FIG. 8 shows the rotating playground equipment 100 in accordance with another embodiment of the present invention. Configuration of the handle is different from the rotating playground equipment 100 of the preferred embodiment 1. However the configuration of other components is the same as the rotating playground equipment 100 of detailed description of the preferred embodiment 1. Therefore, the descriptions of the substrate 110, the column 120, and the drive motor 210 are omitted.

As shown in FIG. 2 and FIG. 8, a supporting rod 810 is horizontally supported to a handle support 240 of the driving motor support 230. In the present embodiment, four pairs of supporting rods 810 are supported to the handle support 240 so that four pairs of supporting rods 810 are perpendicular to each other on identical flat surfaces as two supporting rods 810 are one pair. Next, front ends of each supporting rod 810 are fixed by the ring 520.

Figure 9:
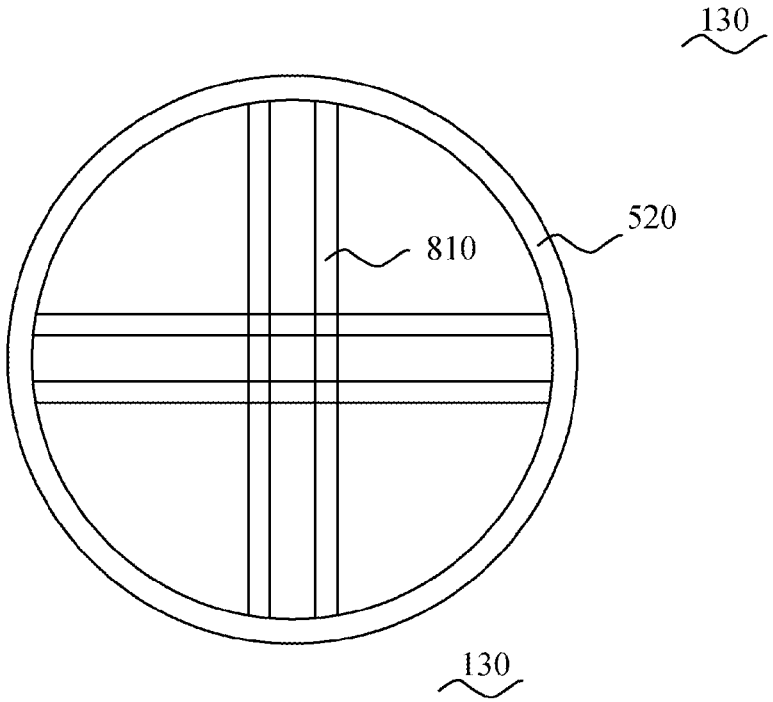
FIG. 9 is a top view illustrating an outlined configuration of a handle placed in a rotating playground equipment in accordance with an embodiment of the present invention.
Figure 9:
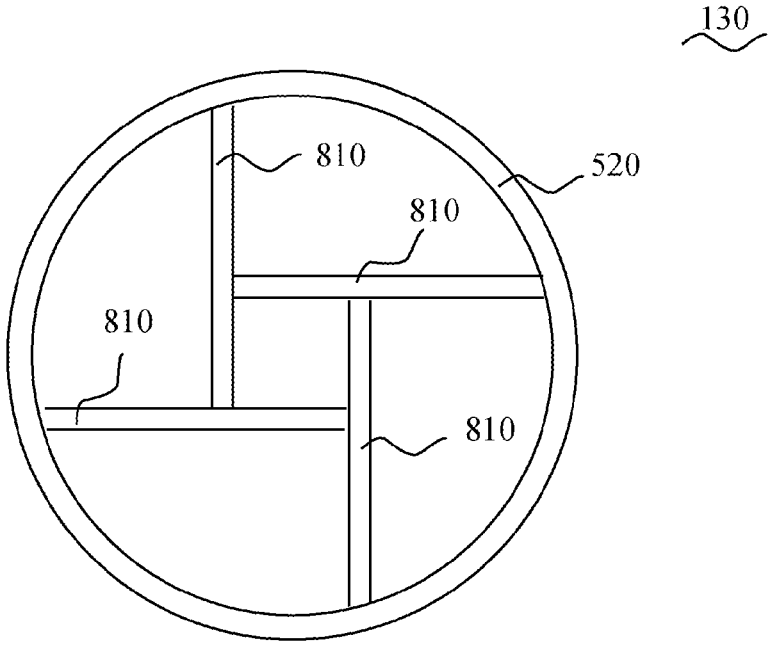

Alternatively, as shown in FIG. 9, four supporting rods 810 are fixed so that the supporting rods are perpendicular to each other on identical flat surfaces. On this occasion, one end of each supporting rod 810 is fixed on the side of another supporting rod 810 so that a rectangle shape is formed in middle. Alternatively, a pair of T-shaped supporting rods formed of connecting two supporting rods 810 into a T-shape are formed. And, the ends of each T-shaped supporting rods are connected so that rectangle shape is formed in middle.

At this time, a connecting point of the supporting rod 810 is regulated so that the rectangular can be placed on the top surface of handle support 240. And, a circle-shaped handle 130 is formed by fixing the other end of each four supporting rods 810 into the ring 520. The handle formed in this way may be placed on the handle support 240. That is to say, the T-shaped supporting rod functions as a beam to the ring 520.

Then the plurality of vertically placed rods 510 are hung from the end of the ring 520. In this embodiment, the vertically placed rod 510 is hung so as to fix to end of the supporting rod 810 of opposite position. Furthermore, another ring 520 is fixed to ring 520 where the vertically placed rod 510 is fixed, at an angle, and the rotating playground equipment 100 may be configured by coupling the ring 520 by zigzag-shaped in total. At this time, each ring 520 is fixed by the vertically placed rod 510.

Detailed Description of the Preferred Embodiment 3

Figure 10:
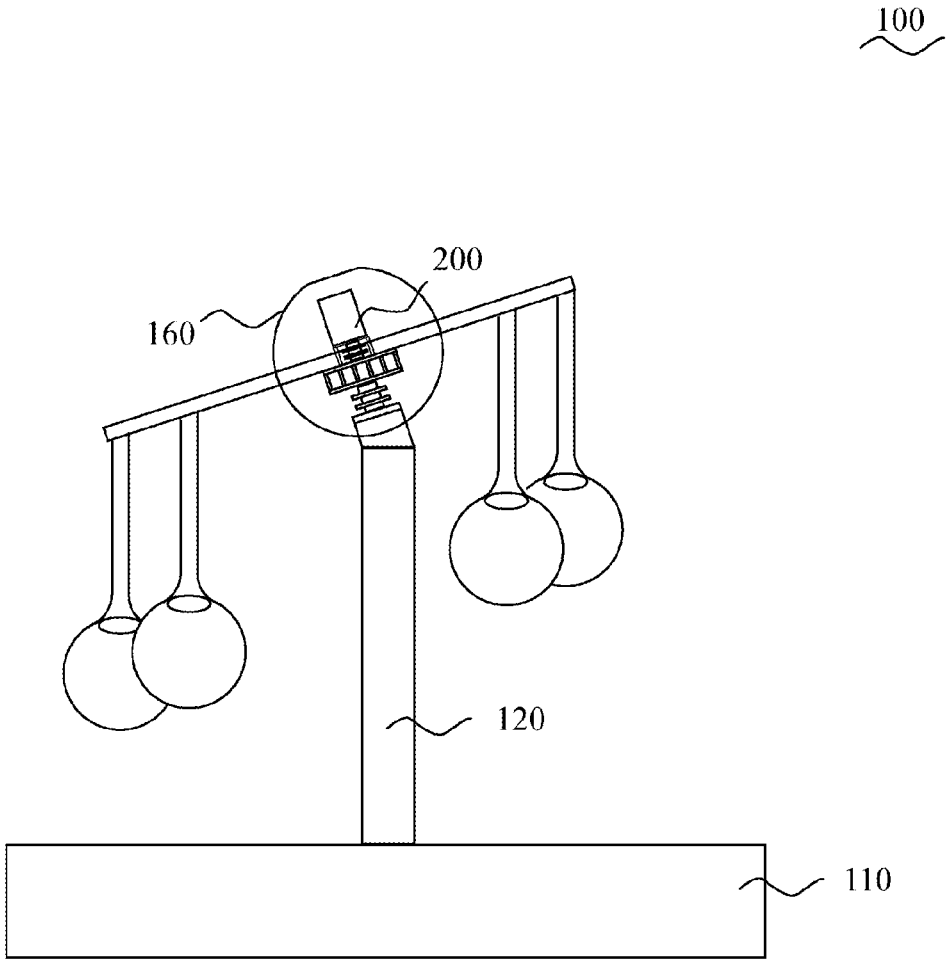
FIG. 10 is a side-view illustrating an outlined configuration of a rotating playground equipment in accordance with an embodiment of the present invention.

FIG. 10 shows another embodiment of the rotating playground equipment 100 of the present invention. In the rotating playground equipment 100 of the present embodiment, the motor-placement device 200 is placed on a column 120 bent at the upper part. Regarding the configuration to bend the upper column 120, it is same as the rotating playground equipment 100 described in detailed description of the preferred embodiment 1. Therefore the description of the configuration other than above, is omitted.

The column 120 bent at the upper part is connected to the substrate 110, and the lower stationary component 250 of the motor-placement device 200 is fit in the upper part of the column 120. The rotating playground equipment 100 of the present embodiment is formed by hanging the handle 130. At this time, circle-shaped handle 130 used in the detailed description of the preferred embodiment 2 may be placed to the motor-placement device 200. Of course, another handle such as balls may be hung from the circle-shaped handle 130. Furthermore, like the detailed description of the preferred embodiment 1, the motor-placement device 200 including the drive motor 210 is surrounded with the protective member 160.

Detailed Description of the Preferred Embodiment 4

Figure 11:
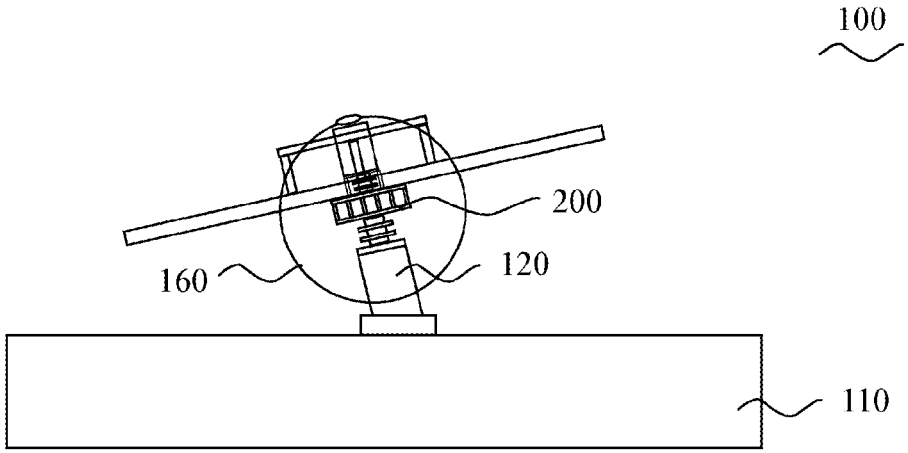
FIG. 11 is a side-view illustrating an outlined configuration of a rotating playground equipment in accordance with an embodiment of the present invention.
Figure 11:
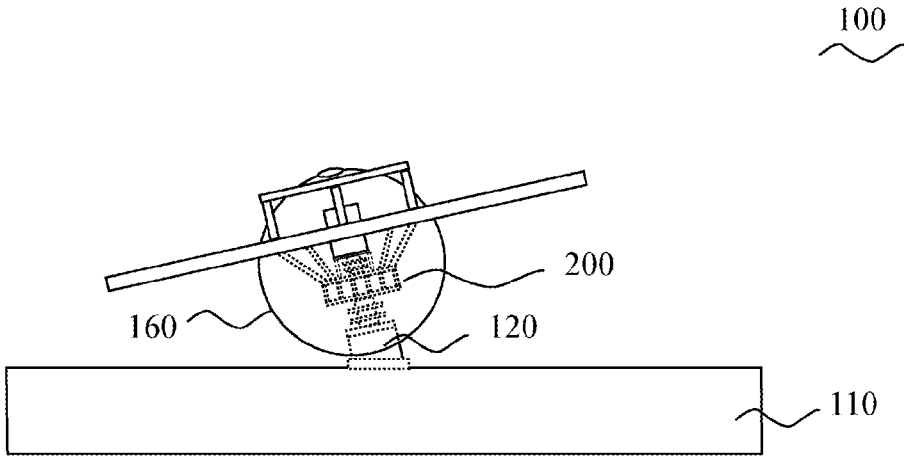

FIG. 11 shows another embodiment of the rotating playground equipment 100 of the present invention. In the rotating playground equipment 100 of the present embodiment, the bent column 120 used with the preferred embodiment 3 is regulated in height so as to be within the users such as children reach. And, the handle capable of holding a central portion is placed to the motor-placement device 200. Regarding the configuration other than above description, it is same as the rotating playground equipment 100 described in the detailed description of the preferred embodiments 1 to 3. Therefore, drawing and description are omitted about the configuration other than the above description.

Figure 12:
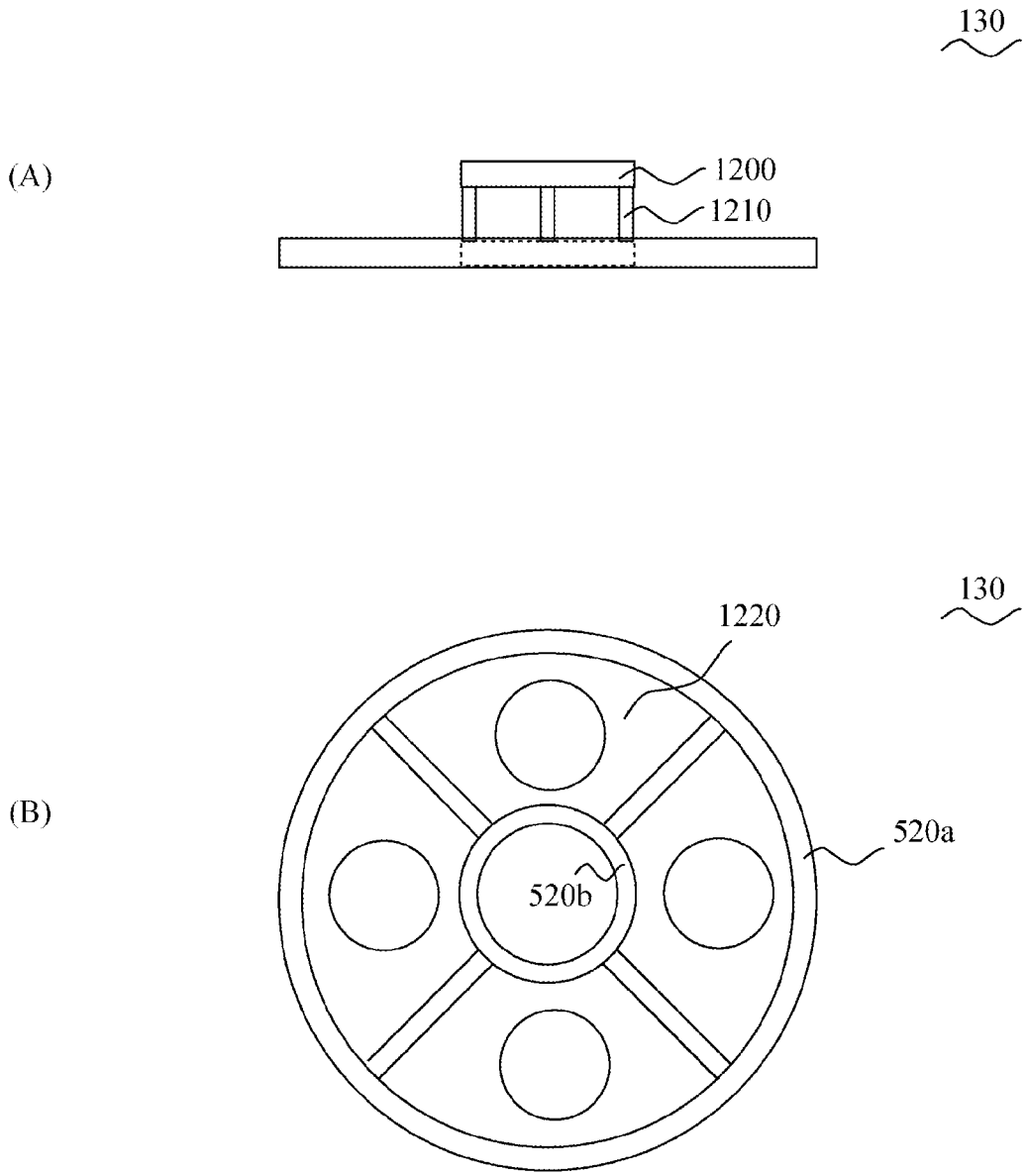
FIG. 12 is a side-view and a top view illustrating an outlined configuration of a handle placed in a rotating playground equipment in accordance with an embodiment of the present invention.

At first, the handle 130 placed on the motor-placement device 200 is explained. As shown in FIG. 12, the handle 130 of the present embodiment comprises a central handle portion 1200. That is to say, a small ring 520 is placed in the center of a large ring 520, the central handle portion 1200 is placed in the upper parts of the small ring 520. In the present embodiment, ring in the same configuration of small ring 520 is placed in the upper part of the small ring 520 as the central handle portion 1200. For example, a small supporting rod 810 for supporting the central handle portion 1200 may be stood to the small ring 520. In this case, the small ring 520 and small supporting rod 810 is corresponding to the central handle portion 1200.

The handle 130 of the present example may be used in any shape, in so far as the central handle portion 1200 can be placed in the upper part of the handle 130. For example, in substitution for the large ring 520, the circle-shaped handle 130 used with the preferred embodiment 2 may be used. Furthermore, the shape of the central handle portion 1200 is not limited to a circle, any shape such as a rectangular shape and a polygon shape is preferably used. Furthermore, a flexible sheet 1220 is coated between the large ring 520 and the small ring 520 in order to prevent the fall of the user. At this time, it may be coated by a transparence sheet so as to view the underside while users hold on the central handle portion 1200. A circle-shaped opening (any shape may be used) is formed, only the opening may be coated in the transparence sheet.

A handle 130 (hereinafter called a handle with central handle portion 130) provided with the central handle portion 1200 configured as above is placed to the motor-placement device 200. Any placement means to the motor-placement device 200 may be used, and the handle with central handle portion 130 may be directly placed to the motor-placement device 200 as shown in FIG. 11 (A). Furthermore, as shown in FIG. 11 (B), the handle with central handle portion 130 may be supported by a supporting rod 810 vertically arranged from the motor-placement device 200.

(Others)

In attaching the drive motor 210 to the motor-placement device 200, overload protection means for example a torque limiter for protecting the drive motor 210 from overload may be provided. As mentioned above, the rotating playground equipment attaching the motor-placement device of the present invention is designed on the assumption that it hold and move the weight of a plurality of users. By the above configuration, if the loads more than specified is added to the drive motor 210, the overload protection means detects the load, and idles the drive motor 210

Furthermore, a torque sensor for detecting running torque may be provided. As the torque sensor, a contact-type torque sensor may be used, alternatively a noncontact torque sensor may be used too. If a torque detected by the torque sensor is beyond an expected limit, the rotative power from the drive motor 210 is not transmitted to the shaft 260 of the lower stationary component. It is desirable for the torque limiter and the torque sensor to provide to the upper rotator 220 of the motor-placement device 200.

Alternatively, when excessive torque as described above is applied (i.e., when an excessive electric current is carried to the drive motor 210), the inverter which interrupts electric current to the drive motor 210 may be provided in substitution for the torque limiter and torque sensor. It is desirable for the inverter to provide to the upper rotator 220 of the motor-placement device 200.

Furthermore, a slip ring (not shown) is provided for the rotating playground equipment 100, by this slip ring, electric power may be supplied to illuminations member (e.g., the LED ribbon which the device outside is provided with) of the rotating playground equipment 100.

By using the slip ring as power supply means, power feeding can be employed without torsion of the electric wiring, even if the rotating playground equipment rotates. It is desirable for the slip ring to provide to the upper rotator 220 of the motor-placement device 200.

In this embodiment, the upper rotator 220 rotates around the central axle. On the other hand, an opening passing through the shaft 260 can be formed in the place spaced from a central axe of the upper rotator. By this configuration, the upper rotator 220 rotates against the lower stationary component 250. Therefore, the rotating playground equipment 100 that handle makes eccentric rotation around can be configured.

INDUSTRIAL APPLICABILITY

This invention is a playground equipment driving motor-placement device provided with a lower stationary component and an upper rotator. The lower stationary component is provided with a stationary plate that can be removed from the playground equipment and a shaft that stands upright on said stationary plate. And, the upper rotator is rotatable about the shaft of the lower stationary component, and is provided with a handle support that supports handles that users can grasp, and a driving motor support that supports the driving motor. The driving motor support is provided above the handle support. And, a coupling fixed to the upper portion of a shaft, for conveying the rotation of the drive motor to a shaft of the lower stationary component is provided.

By the above configuration, the upper rotator is rotatable against the lower stationary component, and a drive motor is placeable to an upper part of the driving motor support of the upper rotator. And, a coupling is fixed to the upper portion of a shaft, for conveying the rotation of the drive motor to a shaft of the lower stationary component, so the playground equipment placing a drive motor to the upper part and rotating the whole apparatus, can be easily configured by using the playground equipment driving motor-placement device of the present invention. Therefore, it can be evaded that a drive motor occupies most of the space of the playground equipment. And it can diffuse the heat of the drive motor from the upper part. And the rotating playground equipment having an ease of for maintenance can be provided, which makes them industrially useful.

What is claimed is:

1. A playground equipment driving motor-placement device, comprising:

a stationary plate removably coupled to a playground equipment;

stationary vertically extending from the stationary plate, the shaft and the stationary plate defining a lower stationary component;

an upper rotator capable of rotating around the shaft of the lower stationary component, said upper rotator including:

a handle support for supporting a handle capable of griping by a user; a drive motor support provided on the upper part of the handle support, for supporting a drive motor; a coupling fixed to a shaft of the motor and the stationary shaft, for conveying the rotation of the drive motor such that the handle support rotates relative to the lower stationary component.

2. The playground equipment driving motor-placement device according to claim 1, further comprising a torque limiter provided on the upper rotator, for controlling a driving torque of the rotating shaft of the drive motor within a predetermined value.

3. The playground equipment driving motor-placement device according to claim 1, further comprising an inverter provided on the upper rotator, for stopping a supply to the drive motor, when currents more than or equal to a predetermined value are supplied to the drive motor.

4. The playground equipment driving motor-placement device according to claim 1, further comprising a slip ring provided on the upper rotator, for supplying electric power to the playground equipment driving motor-placement device.

5. The playground equipment driving motor-placement device according to claim 1, wherein the upper rotator makes eccentric rotation.

6. The playground equipment driving motor-placement device as set out in claim 1, wherein the drive motor is mounted with its shaft facing downward.

7. A rotating playground equipment, comprising:

a substrate;

a column vertically arranged on the substrate;

a playground equipment driving motor-placement device, comprising:

a stationary plate removably coupled to the column;

stationary vertically extending from the stationary plate, the shaft and the stationary plate defining a lower stationary component;

an upper rotator capable of rotating around the shaft of the lower stationary component, said upper rotator including:

a handle support for supporting a handle capable of griping by a user; a drive motor support provided on the upper part of the handle support, for supporting a drive motor; a coupling fixed to a shaft of the motor and the stationary shaft, for conveying the rotation of the drive motor such that the handle support rotates relative to the lower stationary component;

a coating unit having a heat releasing unit provided on the upper part thereof, for surrounding the playground equipment driving motor-placement device including the drive motor.

8. The rotating playground equipment according to claim 7, further comprising a handle supported to the handle support of the playground equipment driving motor-placement device.

9. The rotating playground equipment according to claim 8, further comprising several pairs of different-sized arm-shaped members supported to the handle support of the playground equipment driving motor-placement device, a double ring for horizontally coupling supporting rods hung from ends of the pair of the arm-shaped members.

10. The rotating playground equipment according to claim 7, wherein the handle is a plurality of arm-shaped members, and a supporting rod hung from ends of each arm-shaped member, and a ring for horizontally coupling the each supporting rod.

11. The rotating playground equipment according to claim 10, wherein the handle being zigzag-shape in lateral view.

12. The rotating playground equipment according to claim 7, wherein the upper part of the column is bent, and the playground equipment driving motor-placement device is placed on the upper part of the column being bent.

13. The rotating playground equipment according to claim 12, wherein the handle is placed on the handle support of the playground equipment driving motor-placement device, the handle is a ring having a central handle portion, and further comprising a flexible sheet including at least a transmittance sheet, for coating between the central handle portion and the ring.

* * * * *